US008348788B2

(12) United States Patent
Nye et al.

(10) Patent No.: US 8,348,788 B2
(45) **Date of Patent: *Jan. 8, 2013**

(54) HEIGHT ADJUSTMENT MECHANISM FOR A BASKETBALL SYSTEM

(75) Inventors: S. Curtis Nye, Clinton, UT (US); Brent Steed, Syracuse, UT (US)

(73) Assignee: Lifetime Products, Inc.UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/253,762

(22) Filed: Oct. 5, 2011

(65) Prior Publication Data

US 2012/0028740 A1 Feb. 2, 2012

Related U.S. Application Data

(63) Continuation of application No. 12/192,046, filed on Aug. 14, 2008, now Pat. No. 8,062,152.

(60) Provisional application No. 60/955,866, filed on Aug. 14, 2007, provisional application No. 61/026,392, filed on Feb. 5, 2008.

(51) Int. Cl.
*A63B 63/08* (2006.01)

(52) U.S. Cl. ..... 473/484; D21/701

(58) Field of Classification Search ..... 473/481–485; D21/701, 704

See application file for complete search history.

(56) References Cited

U.S. PATENT DOCUMENTS

| | | | |
|---|---|---|---|
| 2,321,378 | A | 6/1943 | Green |
| 3,025,058 | A | 3/1962 | Brumfield |
| 4,145,044 | A | 3/1979 | Wilson |
| 4,185,936 | A | 1/1980 | Takahashi |
| 4,285,518 | A | 8/1981 | Pearo |
| 4,424,968 | A | 1/1984 | Smith |
| 4,465,277 | A | 8/1984 | Dittrich |
| 4,723,777 | A | 2/1988 | Jolly |
| 4,762,319 | A | 8/1988 | Krumholz |
| 4,781,375 | A | 11/1988 | Nye |
| 4,805,904 | A | 2/1989 | Nye |
| 4,881,734 | A | 11/1989 | Nye |

(Continued)

FOREIGN PATENT DOCUMENTS

CN 2640548 9/2004

(Continued)

OTHER PUBLICATIONS

U.S. Appl. No. 12/192,046, Aug. 4, 2010, Office Action.

(Continued)

*Primary Examiner* — Gene Kim
*Assistant Examiner* — M. Chambers
(74) *Attorney, Agent, or Firm* — Workman Nydegger

(57) ABSTRACT

In one example, a basketball system includes a basketball goal, a support structure, a connecting structure connecting the basketball goal and the support structure, and a height adjustment mechanism connected to the support structure and the connecting structure. The height adjustment mechanism includes: a biasing mechanism connected at least indirectly to the connecting structure and including a locking pin movable between a first position where the biasing mechanism is locked and a second position where the biasing mechanism is unlocked; and, a handle including an outer surface configured such that rotation of the handle results in a corresponding linear movement of the locking pin as the outer surface slidingly engages the locking pin. The height adjustment mechanism is configured such that a single movement of the handle is sufficient to effect both unlocking of the biasing mechanism and adjustment of a height of the basketball goal.

18 Claims, 14 Drawing Sheets

U.S. PATENT DOCUMENTS

| | | | | |
|---|---|---|---|---|
| 5,112,023 | A | 5/1992 | Sowers | |
| 5,114,141 | A | 5/1992 | Mahoney | |
| 5,120,054 | A | 6/1992 | Wetzel | |
| 5,133,547 | A | 7/1992 | Pardi | |
| 5,154,414 | A | 10/1992 | Auer | |
| 5,207,407 | A | 5/1993 | Fitzsimmons | |
| 5,248,140 | A | 9/1993 | Matherne | |
| 5,259,612 | A | 11/1993 | Matherne | |
| 5,324,027 | A | 6/1994 | Nye | |
| 5,375,835 | A | 12/1994 | Van Nimwegen et al. | |
| 5,377,976 | A | 1/1995 | Matherne | |
| 5,415,393 | A | 5/1995 | Fitzsimmons | |
| 5,556,088 | A | 9/1996 | Mower | |
| 5,573,237 | A | 11/1996 | Van Nimwegen et al. | |
| 5,586,759 | A | 12/1996 | Fitzsimmons | |
| 5,695,417 | A | 12/1997 | Winter et al. | |
| 5,730,668 | A | 3/1998 | Hege | |
| 5,738,601 | A * | 4/1998 | Hughes | 473/484 |
| 5,816,955 | A | 10/1998 | Nordgran | |
| 5,839,982 | A | 11/1998 | Hying | |
| 5,879,247 | A | 3/1999 | Winter et al. | |
| 6,004,231 | A | 12/1999 | Schickert | |
| 6,042,297 | A | 3/2000 | Lah | |
| 6,077,177 | A | 6/2000 | Winter et al. | |
| 6,120,396 | A | 9/2000 | Van Nimwegen et al. | |
| 6,135,901 | A | 10/2000 | VanNimwegen | |
| 6,142,891 | A | 11/2000 | Winter et al. | |
| 6,155,938 | A | 12/2000 | Mower | |
| 6,273,834 | B1 | 8/2001 | Winter | |
| 6,283,878 | B1 | 9/2001 | White | |
| 6,334,822 | B1 | 1/2002 | Zider | |
| 6,367,948 | B2 | 4/2002 | Branson | |
| 6,402,644 | B2 | 6/2002 | Stanford et al. | |
| 6,419,597 | B1 | 7/2002 | VanNimwegen et al. | |
| 6,419,598 | B1 | 7/2002 | Winter et al. | |
| 6,422,957 | B1 * | 7/2002 | Winter et al. | 473/484 |
| 6,432,003 | B1 | 8/2002 | VanNimwegen et al. | |
| 6,468,373 | B1 | 10/2002 | Grinwald | |
| 6,488,599 | B2 | 12/2002 | Nye | |
| 6,645,095 | B1 | 11/2003 | Nye et al. | |
| D484,200 | S | 12/2003 | Nye | |
| 6,656,065 | B2 | 12/2003 | Nye | |
| D484,933 | S | 1/2004 | Stanford | |
| 6,699,146 | B1 | 3/2004 | Winter et al. | |
| 6,758,768 | B2 | 7/2004 | Spencer | |
| D498,800 | S | 11/2004 | Nye | |
| 6,824,481 | B1 | 11/2004 | Nye | |
| D503,441 | S | 3/2005 | Stanford | |
| 6,866,596 | B2 | 3/2005 | Steed | |
| 6,881,162 | B2 | 4/2005 | Nye | |
| 6,916,257 | B1 | 7/2005 | VanNimwegen et al. | |
| 6,994,502 | B2 | 2/2006 | Winter | |
| 7,001,290 | B2 | 2/2006 | Mower | |
| 7,044,867 | B2 | 5/2006 | VanNimwegen et al. | |
| 7,048,655 | B2 | 5/2006 | Nye | |
| 7,052,418 | B2 | 5/2006 | Nye | |
| 7,097,574 | B2 | 8/2006 | Nye | |
| 7,118,500 | B2 | 10/2006 | Nye | |
| D532,466 | S | 11/2006 | Nye | |
| 7,195,571 | B2 | 3/2007 | Nye | |
| 7,604,555 | B2 | 10/2009 | Nye | |
| 7,691,014 | B2 | 4/2010 | Nye | |
| 7,691,015 | B2 | 4/2010 | Nye | |
| 7,775,917 | B2 | 8/2010 | Nye | |
| 8,062,152 | B2 * | 11/2011 | Nye et al. | 473/484 |
| 8,172,706 | B2 | 5/2012 | Peery | |
| 2001/0024984 | A1 | 9/2001 | Stanford et al. | |
| 2006/0116225 | A1 | 6/2006 | Kilpatrick | |
| 2009/0069130 | A1 | 3/2009 | Nye et al. | |

FOREIGN PATENT DOCUMENTS

| | | |
|---|---|---|
| CN | 200880000008 | 12/2010 |
| CN | 200880000008 | 10/2011 |

OTHER PUBLICATIONS

U.S. Appl. No. 12/192,046, Apr. 4, 2011, Final Office Action.
U.S. Appl. No. 12/192,046, Jun. 23, 2011, Advisory Action.
U.S. Appl. No. 12/192,046, Jul. 18, 2011, Notice of Allowance.
U.S. Appl. No. 13/403,226, filed Feb. 23, 2012, Astle.
U.S. Appl. No. 11/625,677, filed Jan. 22, 2007, Nye.
U.S. Appl. No. 11/836,121, filed Aug. 8, 2007, Nye.
U.S. Appl. No. 13/533,714, filed Jun. 26, 2012, Green.
Spalding Equipment—2500 Portable Backstop, Recreational Portables; www.spaldingequipment.com/products; Jun. 25, 2012.
U.S. Appl. No. 11/836,121, mailed Jun. 1, 2009, Office Action.
U.S. Appl. No. 11/836,121, mailed Mar. 5, 2010, Final Office Action.
U.S. Appl. No. 11/836,121, mailed Jul. 25, 2011, Office Action.
U.S. Appl. No. 11/836,121, mailed Dec. 7, 2011, Final Office Action.
U.S. Appl. No. 11/625,677, mailed May 6, 2009, Office Action.
U.S. Appl. No. 11/625,677, mailed Mar. 10, 2010, Final Office Action.
U.S. Appl. No. 11/625,677, mailed Sep. 23, 2010, Office Action.
U.S. Appl. No. 11/625,677, mailed Apr. 14, 2011, Final Office Action.
U.S. Appl. No. 11/625,677, mailed Mar. 19, 2012, Office Action.

* cited by examiner

HEIGHT ADJUSTMENT MECHANISM FOR A BASKETBALL SYSTEM

CROSS REFERENCE TO RELATED APPLICATIONS

This application is a continuation of, and claims priority to, U.S. patent application Ser. No. 12/192,046, entitled HEIGHT ADJUSTMENT MECHANISM FOR A BASKETBALL SYSTEM, which was filed on Aug. 14, 2008. U.S. patent application Ser. No. 12/192,046, entitled HEIGHT ADJUSTMENT MECHANISM FOR A BASKETBALL SYSTEM, which was filed on Aug. 14, 2008 claims priority to and the benefit of U.S. Provisional Patent Application Ser. No. 60/955,866, entitled BASKETBALL SYSTEM, which was filed on Aug. 14, 2007; and U.S. Provisional Patent Application Ser. No. 61/026,392, entitled HEIGHT ADJUSTMENT MECHANISM FOR A BASKETBALL SYSTEM, which was filed on Feb. 5, 2008. Each of the aforementioned applications is incorporated herein in its entirety by this reference.

BACKGROUND OF THE INVENTION

1. Field of the Invention

The present invention is generally directed towards sporting equipment and, in particular, to a height adjustment mechanism for a basketball system.

2. Description of Related Art

The game of basketball is played by many people throughout the United States and the world. Briefly, the game of basketball typically includes a flat and level playing surface with a basketball goal at each end of the court. The basketball goal, which may include a backboard and a rim or hoop, is typically attached to the top of a support pole. The rim or hoop is normally located ten feet above the playing surface and the backboard may be constructed from materials such as wood, metal, plastic or tempered glass.

Conventional basketball goals typically include a backboard that is perpendicular to the playing surface and a rim that is parallel to the playing surface. The rim is often rigidly mounted to the basketball backboard, but the rim may also be pivotally mounted to the basketball backboard to create a movable or "break-away" type rim.

Known basketball systems may be permanently secured in a fixed location. For example, the end of the support pole may be inserted into the ground and secured in a set position. Portable basketball systems, in which the system may be selectively moved from one location to another, are also known. Conventional portable basketball systems may include a base with a hollow interior portion that is sized and configured to be filled with ballast such as sand or water. These known portable basketball systems may include one or more wheels to facilitate movement of the basketball system. These known portable basketball systems may also include a handle to facilitate movement of the basketball system.

Basketball systems that allow the height of the basketball goal to be adjusted relative to the playing surface are also known. These known adjustable height basketball systems may allow basketball to be played and/or practiced by a wide variety of persons. For instance, adjustable height basketball systems may be used by relatively tall players for some games and by shorter players during other games. Adjustable height basketball systems may also be used by players of different strengths or skill levels. In addition, adjustable height basketball systems may be used by adults and children. Further, adjustable height basketball systems may be used to play a regulation game of basketball or for practicing skills such as dunking the basketball.

Many conventional adjustable height basketball systems are difficult and/or time consuming to adjust. In addition, many conventional adjustable height basketball systems have complicated designs with numerous parts and connections, which may undesirably increase the cost of the system and make the system time consuming and difficult to assemble. Further, many known adjustable height basketball systems are constructed with large and bulky components. Disadvantageously, these large and bulky components may require a large amount of space, interfere with playing basketball and can make the basketball system more difficult to ship, store and/or assemble. The large and bulky components may also create an unpleasing appearance or design of the basketball system.

It may also be difficult and time consuming to adjust the height of many conventional adjustable height basketball systems. For example, some known adjustable height basketball systems require two people and/or two hands to adjust the height of the basketball system. For example, one hand or person may need to operate a release mechanism so that the height of the basketball goal may be adjusted and the other hand or person may then adjust the height of the basketball goal. Additionally, some known adjustable height basketball systems may require the user to perform multiple functions in order to adjust the height of the basketball system. Thus, it may be difficult and awkward to adjust the height on these known basketball systems if two people or hands are required, and/or if multiple functions have to be performed.

BRIEF SUMMARY OF AN EXAMPLE EMBODIMENT

In one example embodiment, a basketball system includes a basketball goal, a support structure, a connecting structure connecting the basketball goal and the support structure, and a height adjustment mechanism connected to the support structure and the connecting structure. The height adjustment mechanism includes: a biasing mechanism connected at least indirectly to the connecting structure and including a locking pin movable between a first position where the biasing mechanism is locked and a second position where the biasing mechanism is unlocked; and, a handle including an outer surface configured such that rotation of the handle results in a corresponding linear movement of the locking pin as the outer surface slidingly engages the locking pin. The height adjustment mechanism is configured such that a single movement of the handle is sufficient to effect both unlocking of the biasing mechanism and adjustment of a height of the basketball goal.

The foregoing and other aspects of embodiments of the invention will become more fully apparent from the following detailed description of example embodiments and appended claims.

BRIEF DESCRIPTION OF THE DRAWINGS

The appended drawings contain figures of preferred embodiments to further illustrate and clarify the above and other aspects, advantages and features of the invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF PREFERRED EMBODIMENTS

The present invention is directed towards a height adjustment mechanism for a basketball system. The principles of the present invention, however, are not limited to height adjustment mechanism for a basketball system. It will be understood that, in light of the present disclosure, the height adjustment mechanism disclosed herein can be successfully used in connection with other types of sports equipment and/or support structures.

Additionally, to assist in the description of the height adjustment mechanism for a basketball system, words such as top, bottom, front, rear, right and left are used to describe the accompanying figures, which are not necessarily drawn to scale. It will be appreciated that the height adjustment mechanism and various components thereof can be located in a variety of desired positions—including various angles, sideways and even upside down. Further, while the accompanying drawings illustrate exemplary embodiments of the height adjustment mechanism and basketball system, the height adjustment mechanism and basketball system may include other parts, components, features, functions, etc., depending, for example, upon the intended use of the height adjustment mechanism and/or basketball system.

For convenience, some of the components shown in the accompanying figures and discussed in detail below may have the same reference numbers. It will be appreciated, however, that these and other components may have different shapes, sizes, configurations and the like depending, for example, upon the intended use of the height adjustment mechanism and/or basketball system. A detailed description of the height adjustment mechanism for basketball system now follows.

Figure 1:
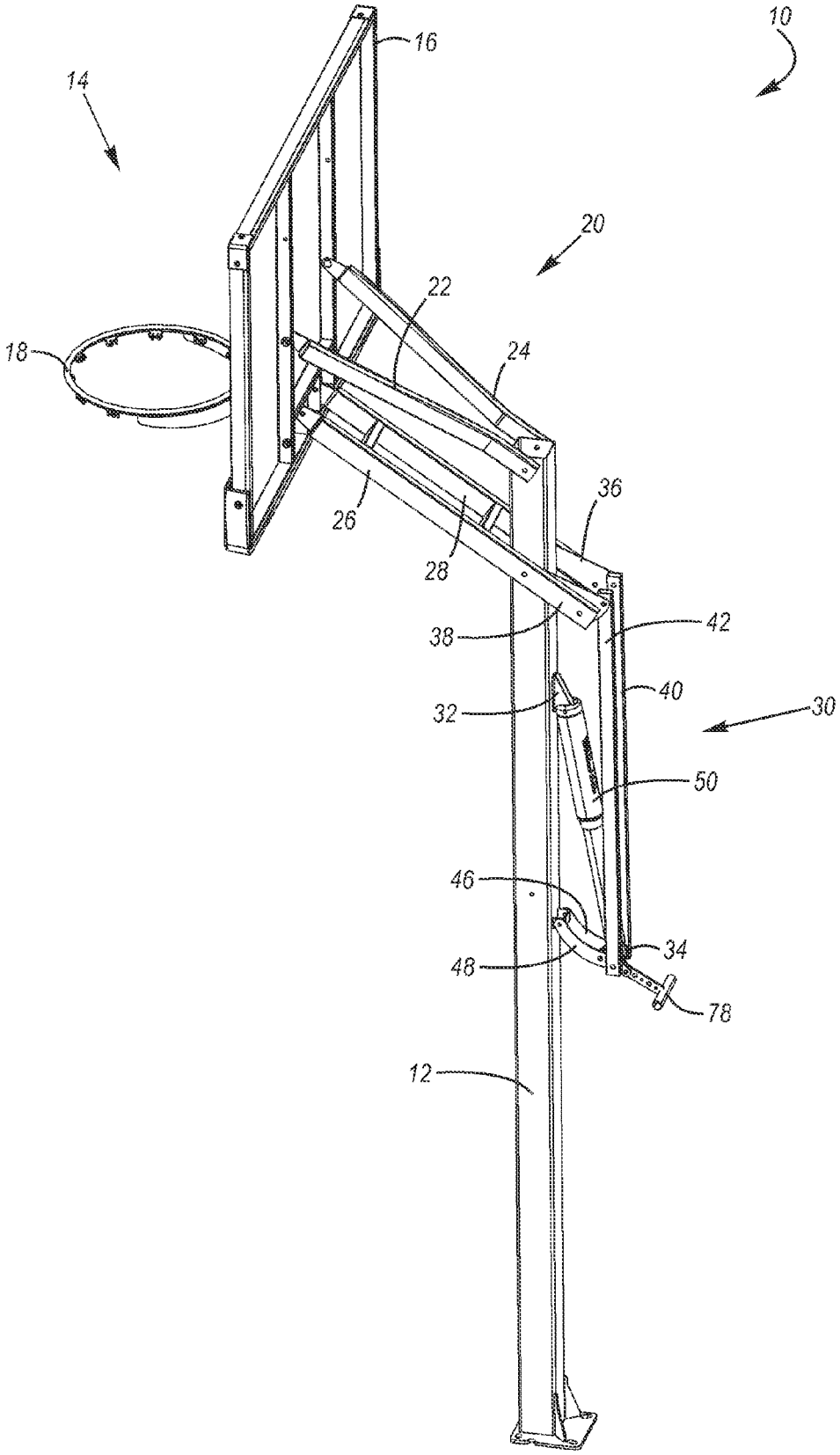
FIG. 1 is a rear perspective view of an exemplary basketball system with a height adjustment mechanism.
Figure 2:
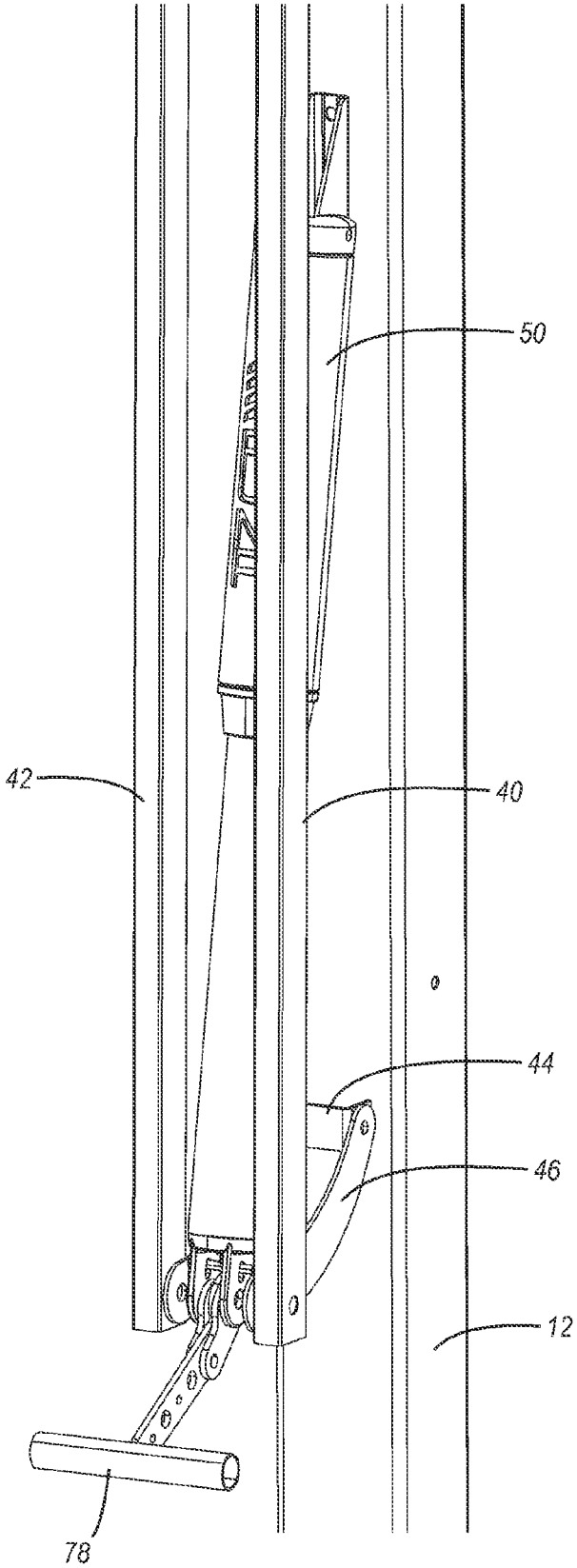
FIG. 2 is an enlarged rear perspective view of a portion of the basketball system shown in FIG. 1.
Figure 3:
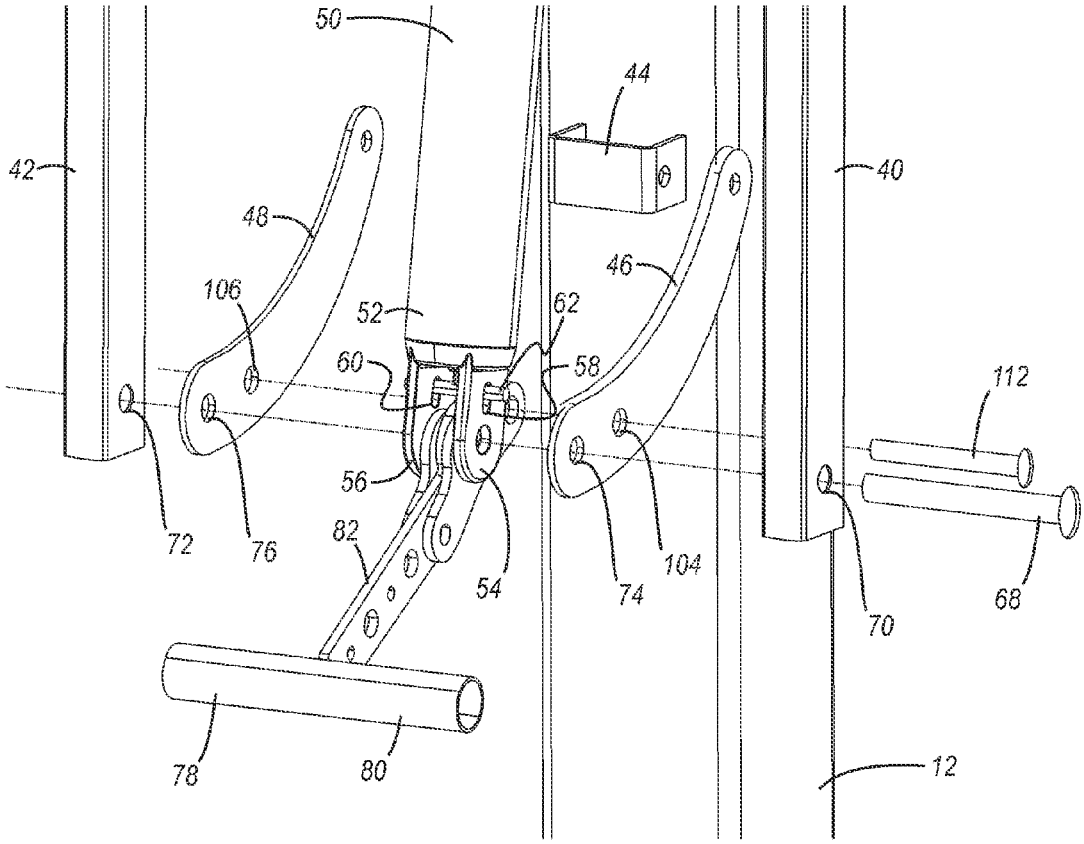
FIG. 3 is an enlarged, partially exploded rear perspective view of a portion of the basketball system shown in FIG. 2.
Figure 4:
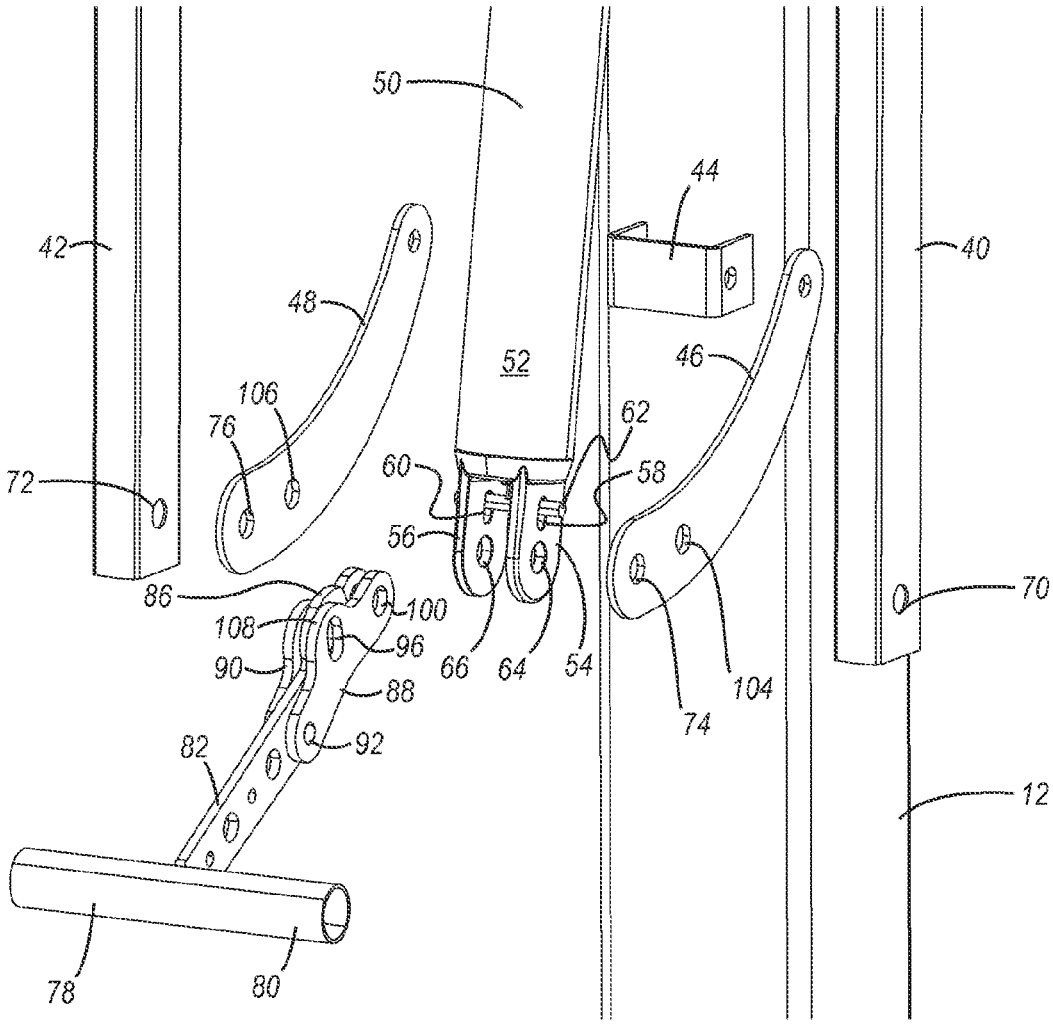
FIG. 4 is another enlarged, partially exploded rear perspective view of a portion of the basketball system shown in FIG. 2.
Figure 5:
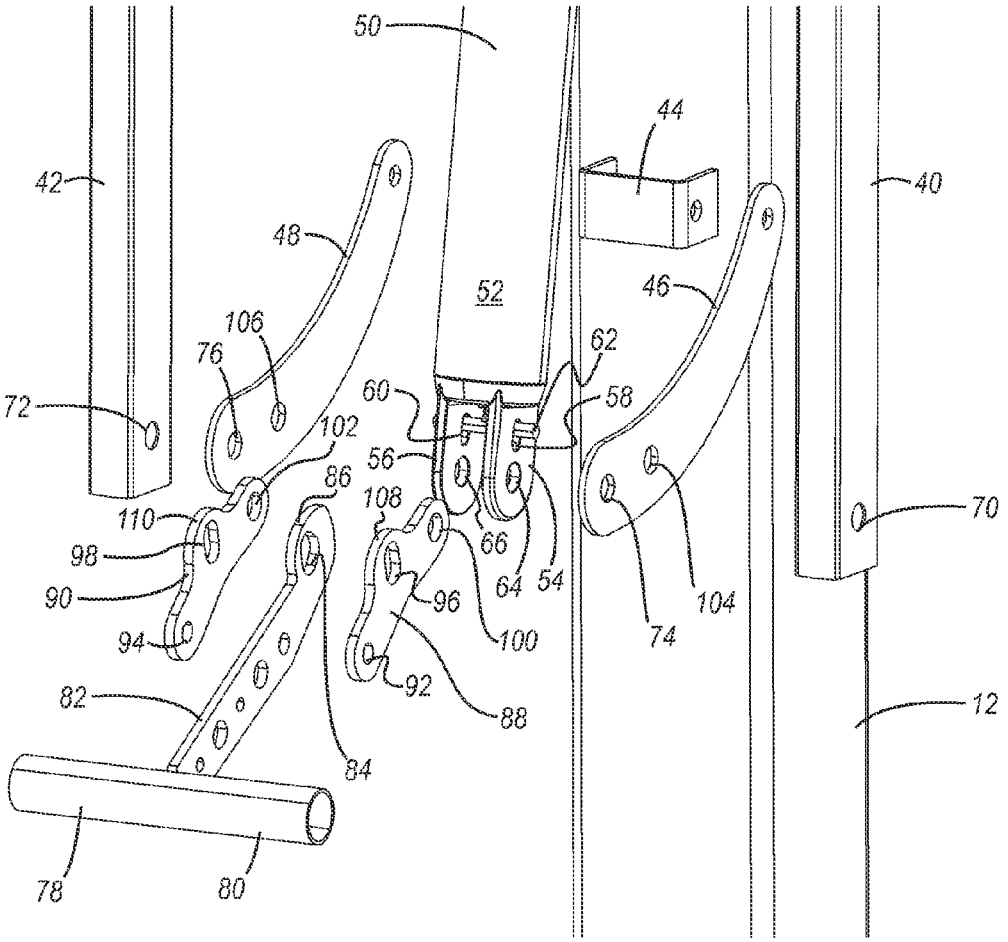
FIG. 5 is still another enlarged, partially exploded rear perspective view of a portion of the basketball system shown in FIG. 2.

As seen in FIG. 1, an exemplary basketball system 10 may include a support structure 12, such as a support pole, that is sized and configured to support a basketball goal 14 above a playing surface. The support structure 12 may include one or more segments that are interconnected, which may facilitate shipping and transportation of the basketball system 10, or a single elongated pole. The basketball goal 14 preferably includes a backboard 16 and a rim 18, and the basketball goal may also include a net connected to the rim. The backboard 16 may be constructed from materials such as glass, metal, plastic and the like. In addition, the backboard 16 may be a unitary, one-piece structure or it may include two or more components. For example, the backboard 16 may include a frame and a rebound member connected to the frame. The frame may be constructed from a relatively strong and durable material, such as metal or plastic, and the rebound member may be constructed from acrylic or other suitable materials. As shown in the accompanying figures, the backboard 16 may have a generally rectangular configuration and it may have a width of about four or five feet, but it will be appreciated that the backboard may have other appropriate shapes, sizes, configurations and arrangements depending, for example, upon the intended use of the basketball system 10. Further, the rim 18 may be secured in a fixed configuration relative to the backboard 16 or the rim may have a displaceable or "break-away" type configuration, if desired.

The basketball system 10 may be part of a portable basketball system that is capable of being moved or a permanent system that is intended to remain in a fixed location. For example, the support structure 12 may be connected to a base to form part of a portable basketball system. The support structure 12 may also be connected to the ground to form an in-ground or permanent basketball system 10. Advantageously, the basketball system 10 may be used in connection with either a portable or permanent basketball system.

The basketball goal 14 is preferably connected to the support structure 12 by a connecting structure 20. The connecting structure 20 is preferably sized and configured to position the backboard 16 in a generally vertical position and the rim 18 in a generally horizontal position relative to the playing surface. The connecting structure 20 may also be sized and configured to allow the height of the basketball goal 14 to be adjusted.

In particular, the connecting structure 20 may allow the rim 18 to be positioned at the standard, regulation height of ten (10) feet for playing the game of basketball. The connecting structure 20 may also allow the rim 18 to be positioned at higher and/or lower heights. For example, the connecting structure 20 may allow the rim 18 to be positioned below the standard height to accommodate children that may lack the ability to shoot at a regulation height rim. In addition, the connecting structure 20 may allow the rim 18 to be positioned above the standard height, if desired.

As shown in the accompanying figures, the connecting structure 20 may include one or more connecting members or arms that interconnect the support structure 12 and the basketball goal 14. For example, the connecting structure 20 may include upper connecting members 22, 24 and lower connecting members 26, 28. If desired, the connecting members 22, 24, 26, 28 may be interconnected by one or more braces, such as shown in FIG. 1.

In order to permit the height of the basketball goal 14 to be adjusted, the connecting members 22, 24, 26, 28 are preferably movable. For example, the upper connecting members 22, 24 are preferably pivotally connected to an upper portion of the support structure 12 and an upper portion of the backboard 16. The lower connecting members 26, 28 are preferably pivotally connected to a lower portion of the support structure and a lower portion of the backboard 16. In addition, the connecting members 22, 24, 26, 28 are preferably disposed in a generally parallelogram-shaped configuration. The connecting members 22, 24, 26, 28 are also preferably connected to the basketball goal 14 and the support structure 12 to form part of a four-bar and/or four-pivot linkage. Advantageously, this may allow the height of the basketball goal 14 to be adjusted while maintaining the backboard 16 and rim 18 in a desired position relative to the playing surface.

In greater detail, the generally parallelogram-shaped configuration may include the portion of the backboard disposed between the upper connecting members 22, 24 and the lower connecting members 26, 28; the upper connecting members; the portion of the support structure 12 disposed between the upper connecting members and the lower connecting members; and the lower connecting members. The upper connecting members 22, 24 are preferably disposed parallel to the lower connecting members 26, 28. In addition, the portion of the backboard disposed between the upper connecting members 22, 24 and the lower connecting members 26, 28 is preferably disposed parallel to the portion of the support structure 12 disposed between the upper connecting members and the lower connecting members. Further, the ends the upper connecting members 22, 24 and the lower connecting members 26, 28 are preferably pivotally connected to the basketball goal 14 and the support member 12, respectively, to form the four-pivot linkage. It will be appreciated that the support structure 12 and the basketball goal 14 may be connected using other suitable structures and arrangements, such as shown in pending U.S. patent application Ser. No. 11/500,791, entitled Basketball System, which was filed on Aug. 7, 2006; pending U.S. patent application Ser. No. 11/625,677, entitled Basketball System, which was filed on Jan. 22, 2007; and pending U.S. patent application Ser. No. 11/836,121, entitled Basketball System, which was filed on Aug. 8, 2007, which are incorporated by reference in their entireties.

The support structure 12 and the connecting structure 20 are preferably constructed from relatively strong materials such as metal or steel. Advantageously, the metal or steel components may allow a strong and durable basketball system 10 to be constructed. It will be appreciated, however, that the support structure 12 and/or connecting structure 20 can be constructed from other materials with suitable characteristics and qualities. It will also be appreciated that the support structure 12, basketball goal 14 and/or connecting structure 20 may have other suitable shapes, sizes, configurations and arrangements depending, for example, upon the intended use of the basketball system 10. For instance, the connecting structure 20 does not require a generally parallelogram-shaped configuration, a four-bar or four-pivot linkage, and any suitable number and arrangement of connecting members may be used to connect the support structure and the basketball goal 14.

A height adjustment mechanism 30 may be used to adjust the height of the basketball goal 14. As shown in FIG. 1, the height adjustment mechanism 30 may include a first portion that is connected to the support structure 12 and a second portion that is connected to the connecting structure 20. In particular, the height adjustment mechanism 30 may include a first end 32 that is connected to the support structure 12 and a second end 34 that is connected to the connecting structure. Advantageously, this positioning of the height adjustment mechanism 30 may allow a user to quickly and easily adjust the height of the basketball goal 14. In addition, this positioning of the height adjustment mechanism 30 may help prevent it from interfering with the use of the basketball system 10. It will be appreciated, however, that the height adjustment mechanism 30 may also be connected to other portions of the basketball system 10 and it may be disposed in other suitable locations.

The height adjustment mechanism 30 is preferably connected to the lower connecting members 26, 28 of the connecting structure 20. For example, as shown in FIG. 1, the lower connecting members 26, 28 may have a longer length than the upper connecting members 22, 24. In particular, the lower connecting members 26, 28 may include extensions 36, 38, respectively, that extend beyond the support structure 12 and away from the basketball goal 14. First and second elongated arms 40, 42 may be connected to the extensions 36, 38 and the arms may be disposed generally parallel to the support structure 12. The upper portions of the arms 40, 42 are preferably pivotally connected to the extensions 36, 38 of the connecting members 26, 28 and the lower portions of the arms are preferably connected to the height adjustment mechanism 30 and the support structure 12. For example, first and second links 46, 48 may be used to connect the arms 40, 42 to the support structure 12.

As shown in the accompanying figures, the basketball system 10 may include a pair of upper connecting members 22, 24; a pair of lower connecting members 26, 28; a pair of extensions 36, 38; a pair of elongated arms 40, 42; and a pair of links 46, 48. It will be appreciated, however, that the basketball system 10 may include any suitable number of connecting members, extensions, arms and/or links. For example, the connecting structure 20 may include three pairs of connecting members or only a single pair of connection members. Additionally, the basketball system 10 could include only one or multiple extensions, arms and/or links. Further, while these connecting members, arms, links, etc. may be shown as individual components, these and other components may be integrally formed as part of a unitary, one-piece structure.

It will further be appreciated that the height adjustment mechanism 30 may be connected to other portions of the basketball system 10 such as the upper connecting members 22, 24. For instance, the upper connecting members 22, 24 may have a longer length that the lower connecting members 26, 28 and/or may extend beyond the support structure 12 and away from the basketball goal 14. The elongated arms 40, 42 may then be connected to the upper connecting members 22, 24. Thus, it will be understood that the basketball system 10 and the accompanying parts and components may have various suitable shapes, sizes, configurations and arrangements depending, for example, upon the intended use of the basketball system.

A biasing mechanism 50 may be sized and configured to bias the basketball goal 14 into a desired position, help maintain the basketball goal in a desired position and/or facilitate movement of the basketball goal. In particular, the biasing mechanism 50 may help facilitate movement of the basketball goal 14 and/or help prevent unintended movement of the basketball goal. For example, the biasing mechanism 50 may be disposed in or include a first position that allows the height of the basketball goal 14 to be adjusted and a second position that at least helps maintain the basketball goal in a fixed position.

The biasing mechanism 50, however, does not have to bias the basketball goal 14 into any particular configuration or position. For example, the biasing mechanism 50 may simply provide a counterbalance or counterweight. For instance, as discussed in more detail below, the biasing mechanism 50 may provide a counterbalance or counterweight to the basketball goal 14 and/or connecting structure 20. Preferably, the biasing mechanism 50 provides sufficient force to allow the height of the basketball goal 14 to be easily adjusted, but the biasing mechanism could provide any desired force.

The biasing mechanism 50 may include one or more shocks, dampers and the like. In particular, the biasing mechanism 50 may include a gas shock, such as a pneumatic shock. The biasing mechanism 50 may also include other types of shocks, such as fluid shocks and the like, and/or one or more springs, such as gas springs, compression springs, tension springs, torsion springs and the like. These springs may be coil springs, cantilever springs, etc. If desired, the biasing mechanism 50 may include one or more different types of springs such as mechanical springs and/or gas springs.

The biasing mechanism 50 is preferably sized and configured to provide a force that at least partially counters the weight of the basketball goal 14. In particular, the biasing mechanism 50 may help provide a counterbalance force that at least partially counters the force of gravity against the basketball goal 14. Advantageously, this may make the height of the basketball goal 14 easier to adjust. The biasing mechanism 50 may also assist in raising and lowering the basketball goal 14, but it may only assist in raising or lowering the basketball goal.

In greater detail, as best seen in FIGS. 2-5, the biasing mechanism 50 may include an end 52 with flanges 54, 56. The flanges 54, 56 may include slots 58, 60, respectively, and a locking pin 62 may be disposed in the slots. The locking pin 62 is preferably moveable within the slots 58, 60 between a first position in which the biasing mechanism 50 is disposed in the locked position and a second position in which the biasing mechanism is disposed in the unlocked position. For example, when the locking pin 62 is in the first position and the biasing mechanism 50 is in the locked position, the locking pin may be disposed away from the biasing mechanism. On the other hand, when the locking pin 62 is in the second position and the biasing mechanism 50 is in the unlocked position, the locking pin may be disposed towards the biasing mechanism.

It will be appreciated that the locking pin 62 and the biasing mechanism 50 may have other suitable arrangements and configurations. For instance, the locking pin 62 may be disposed towards the biasing mechanism 50 when the locking pin is in the first position and the biasing mechanism is in the locked position; and the locking pin may be disposed away from the biasing mechanism when the locking pin is in the second position and the biasing mechanism 50 is in the unlocked position.

The flanges 54, 56 extending outwardly from the end 52 of the biasing mechanism 50 may also include openings 64, 66 that are sized and configured to receive a connector or fastener 68, such as a bolt. The fastener 68 is preferably sized and configured to connect the biasing mechanism 50 to the elongated arms 40, 42 and the links 46, 48. In greater detail, the arms 40, 42 may include openings 70, 72 and the links 46, 48 may include openings 74, 76, respectively. The fastener 68 may extend through the openings 64, 66, 70, 72, 74, 76 to interconnect these components. Thus, the fastener 68 may allow the biasing mechanism 50 to be connected to the support structure 12 by the links 46, 48 and be connected to the connecting structure 20 by the arms 40, 42. As shown in FIGS. 2-5, the links 46, 48 may be connected to the support structure 12 by a bracket 44 but the links 46, 48 may also be directly connected to the support structure 12, if desired.

A handle 78 may be used to adjust the height of the basketball goal 14. As shown in FIGS. 1-5, the handle 78 may have a generally T-shaped configuration with a gripping portion 80 and an elongated body 82. The handle 78 may also include an opening 84 and the fastener 68 may extend through the opening to interconnect the handle, the biasing mechanism 50, the elongated arms 40, 42 and the links 46, 48.

The handle 78 may include a normal or rest position in which the basketball goal 14 may be disposed in a generally fixed position. The handle 78 may also be movable in a first direction to move the basketball goal 14 in one direction and moveable in a second direction to move the basketball goal in a second direction. In particular, the handle 78 may be pulled downwardly and that may raise the basketball goal 14 or the handle may be lifted and that may lower the basketball goal. It will be appreciated that the basketball goal 14 and/or the handle 78 may be moved in different directions depending, for example, upon the geometry and particular arrangement of the basketball system 10.

Desirably, the movement of the handle 78 locks and/or unlocks the biasing mechanism 50 and allows the height of the basketball goal 14 to be adjusted, which preferably happens almost simultaneously and without any other actions being required. Advantageously, this may allow a person to adjust the height of the basketball goal 14 using only one hand. In addition, because the movement of the handle 78 may both lock and/or unlock the biasing mechanism and adjust the height of the basketball goal 14, no other movements or tasks may need to be performed by the user. Thus, no other mechanisms need to be released and/or other functions performed other than simply grasping the handle 78 and moving the handle so that the basketball goal 14 is disposed at the desired height. This one-handed operation of the height adjustment mechanism 30 may allow the height of the basketball goal 14 to be quickly and easily adjusted. In addition, because no other mechanisms need to be used and no other tasks executed, this may allow the height of the basketball goal 14 to be simply and efficiently changed.

In greater detail, the opening 84 in the elongated body 82 of the handle 78 may be disposed between the flanges 54, 56 and the fastener 68 may extend through the openings 64, 66 in the flanges and the opening in the handle. The handle 78 may include an outer surface 86 that is sized and configured to control the movement of the locking pin 62 of the biasing mechanism 50. For example, the outer surface 86 may be curved or shaped to contact the locking pin 62. Advantageously, as the handle 78 is being moved, the outer surface 86 may position the locking pin 62 in the desired locations and that may lock/unlock the biasing mechanism 50. In particular, the outer surface 86 may protrude outwardly from the elongated body 82 and it may help control the movement of the locking pin 62 within the slots 58, 60. For instance, if the handle 78 is in a first position, then the curved outer surface 86 may dispose and/or maintain the locking pin 62 in a first position, such as a locked position. On the other hand, if the handle 78 is in a second position, then the curved outer surface 86 may move or allow the locking pin 62 to be disposed in a second position, such as an unlocked position. Thus, moving the handle 78 may lock and/or unlock the biasing mechanism 50.

One or more brackets may also be used to connect the handle 78 to the biasing mechanism 50 and/or control the movement of the locking pin 62. For example, a first bracket 88 may be disposed on one side of the elongated body 82 of the handle and a second bracket 90 may be disposed on the second side of the elongated body. The brackets 88, 90 may include openings 92, 94 that facilitate attachment of the brackets to the elongated body 82 of the handle 78. For example, a fastener may be inserted through the openings 92, 94 and it may attach the brackets 88, 90 to the handle 78. The brackets 88, 90 may also include slots 96, 98 and the fastener 68 may be disposed within the slots. The brackets 88, 90 may further include openings 100, 102 that may be used to connect the brackets to the links 46, 48. In particular, the links 46, 48 may include openings 104, 106 and a fastener 112 may be used to connect the brackets 88, 90 to the links 46, 48.

The brackets 88, 90 may include outer surfaces 108, 110, which may be similar to the outer surface 86 of the handle 78, that are sized and configured to help control the movement of the locking pin 62 of the biasing mechanism 50. Advantageously, the outer surfaces 108, 110 of the brackets 88, 90 may work in conjunction with the outer surface 86 of the handle 78 to control the movement of the locking pin 62. The outer surfaces 108, 110 of the brackets 88, 90 may also work independently of the outer surface 86 of the handle, if desired. For example, if the handle 78 is in a first position, then the curved outer surfaces 108, 110 may dispose and/or maintain the locking pin 62 in a first position, such as a locked position. On the other hand, if the handle 78 is in a second position, then the curved outer surfaces 108, 110 may move or allow the locking pin 62 to be disposed in a second position, such as an unlocked position.

Figure 6:
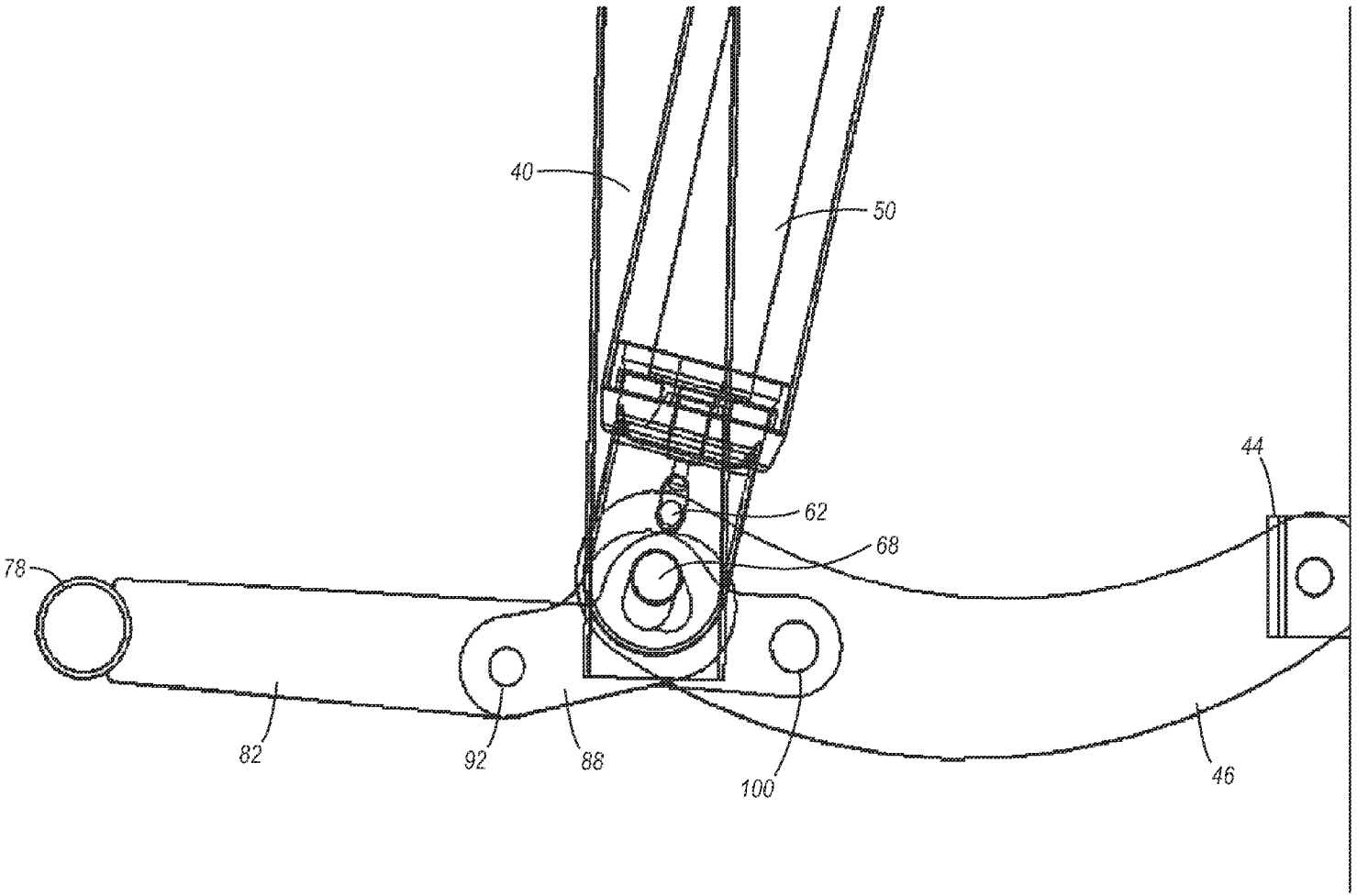
FIG. 6 is a side view of a portion of the basketball system shown in FIG. 2, illustrating the height adjustment mechanism in an exemplary locked position.

In greater detail, if the outer surface 86 and the handle 78 and the outer surface 100, 102 of the brackets 88, 90 are sized and configured to control the movement of the locking pin 62, then movement of the handle may determine the positioning of the locking pin. As discussed above, the positioning of the locking pin 62 may determine if the biasing mechanism 50 is in the locked or unlocked position. For example, as shown in FIG. 6, the handle 78 may be disposed in a normal or first position in which no force is being applied to the handle. Preferably, the handle 78 is biased or predisposed to be in this normal position so that a force has to be applied to the handle 78 to move it from this normal position. As shown in the accompanying figure, the slot 96 in the first bracket 88 and the opening 84 in the handle 78 may not be aligned. In this position, the locking pin 62 is disposed away from the biasing mechanism 50 and the biasing mechanism is in the locked position. Preferably the outer surface 86 of the handle 78 and/or the outer surfaces 108, 110 of the brackets 88, 90 help maintain the locking pin 62 in the first position, which may help maintain the height of the basketball goal 14 in a fixed position. It will be appreciated, however, that the handle 78 does not have to be biased into the first position and the biasing mechanism does not have to be locked in this position.

Figure 7:
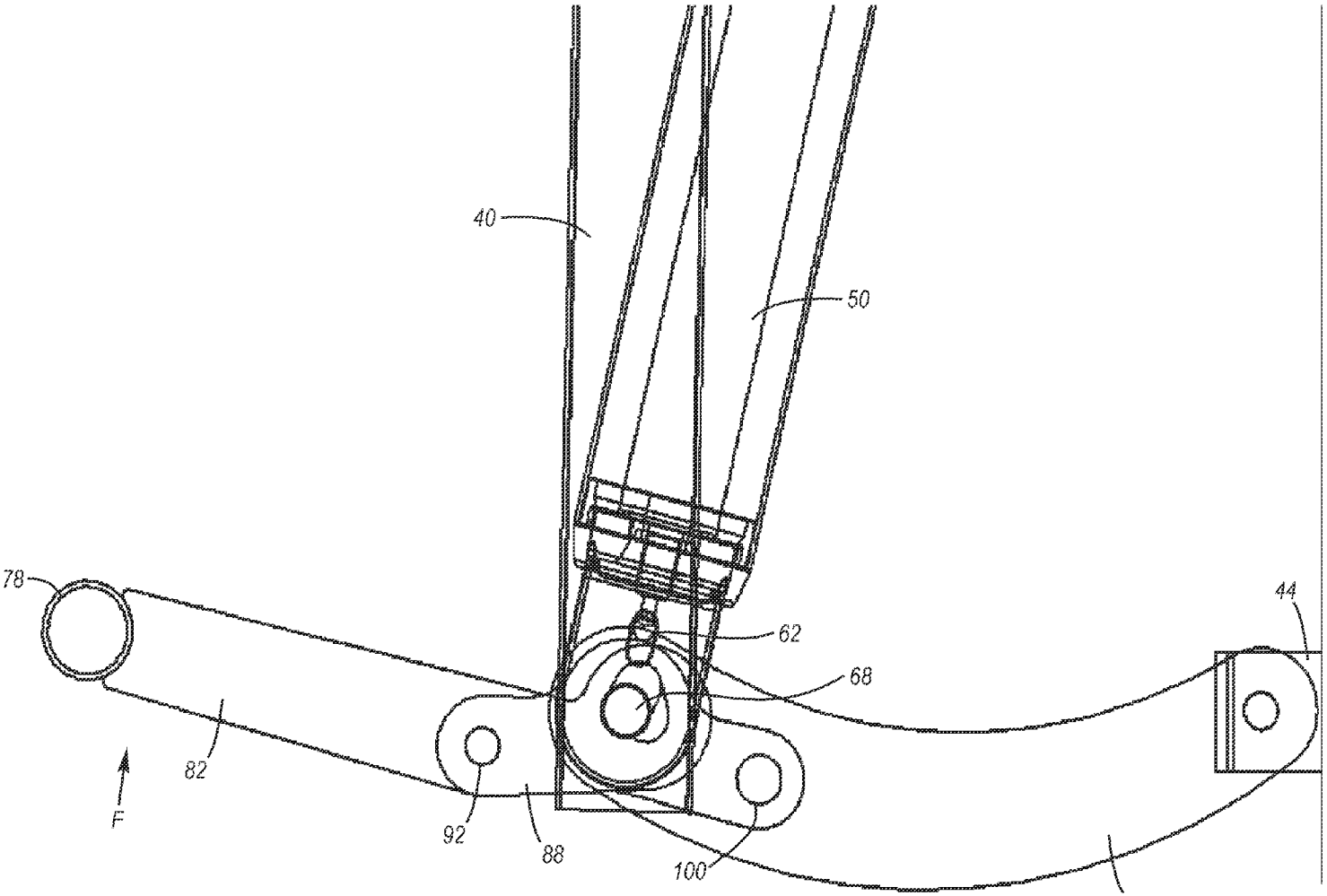
FIG. 7 is a side view of a portion of the basketball system shown in FIG. 2, illustrating the height adjustment mechanism in an exemplary unlocked position.

As shown in FIG. 7, when a force F is applied to the handle 78, the gripping portion 80 of the handle may move upwardly and this may cause the outer surface 86 of the handle 78 and/or the outer surfaces 108, 110 of the brackets 88, 90 to move the locking pin 62 into a second position. When the locking pin 62 is in the second position, the biasing mechanism 50 may be unlocked and the height of the basketball goal 14 may be adjusted. In particular, the upward movement of the handle 78 may cause the biasing mechanism 50 to be unlocked and the height of the basketball goal 14 to be lowered.

Figure 8:
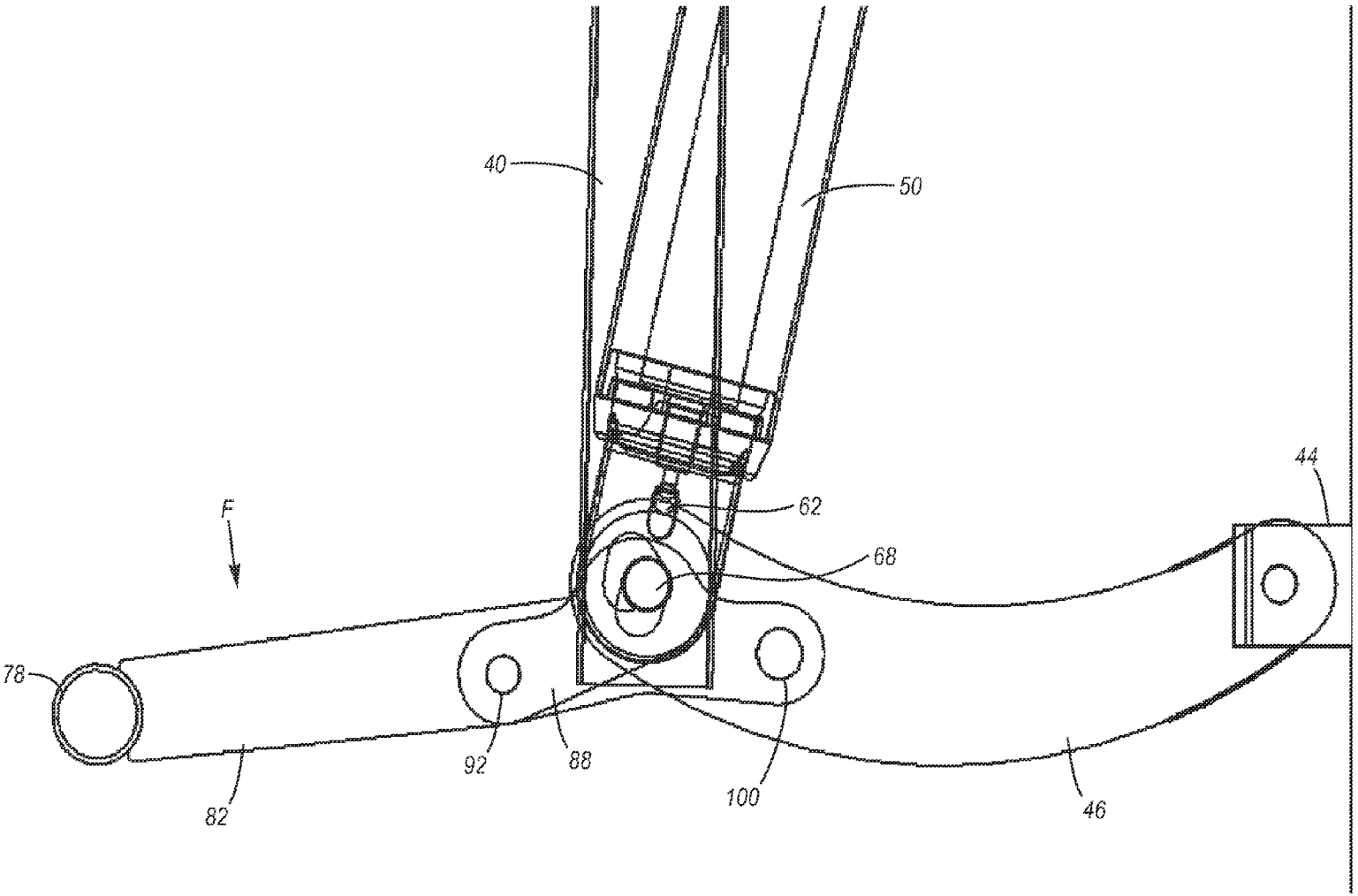
FIG. 8 is a side view of a portion of the basketball system shown in FIG. 2, illustrating the adjustment mechanism in another exemplary unlocked position.

On the other hand, as seen in FIG. 8, when a force F is applied to the handle 78, the gripping portion 80 of the handle may be moved downwardly and this may also cause the outer surface 86 of the handle 78 and/or the outer surfaces 108, 110 of the brackets 88, 90 to move the locking pin 62 into the second position. Thus, once again, the biasing mechanism 50 may be unlocked and the height of the basketball goal 14 may be adjusted. Specifically, the downward movement of the handle 78 may cause the biasing mechanism 50 to be unlocked and the height of the basketball goal 14 to be increased. Therefore, the movement of the handle 78 may lock/unlock the biasing mechanism 50 and allow the height of the basketball goal 14 to be adjusted.

Advantageously, a single movement of the handle 78 may unlock the biasing mechanism and allow the height of the basketball goal 14 to be adjusted. Significantly, no other tasks or functions need to be performed by the user. Thus, this may allow the user to use a single hand to change the height of the basketball goal 14, which may make the basketball system 10 easier to use by a wide range of people.

It will be understood that the handle 78 (including the outer surface 86) and the brackets 88, 90 (including the outer surfaces 108, 110) may have other shapes, sizes, configurations and arrangements depending, for example, upon the particular configuration of the biasing mechanism 50. For example, if the biasing mechanism 50 is disposed in the locked position when the locking pin 62 is disposed proximate the biasing mechanism, then the outer surface 86 of the handle 78 and/or the outer surfaces 108, 110 of the brackets 88, 90 may be sized and configured to maintain the locking pin proximate the biasing mechanism when the handle is in a normal position. The outer surface 86 of the handle 78 and/or the outer surfaces 108, 110 of the brackets 88, 90 may also be sized and configured to position the locking pin 62 away from the biasing mechanism 50 when the handle 78 is moved upwardly or downwardly.

Figure 9:
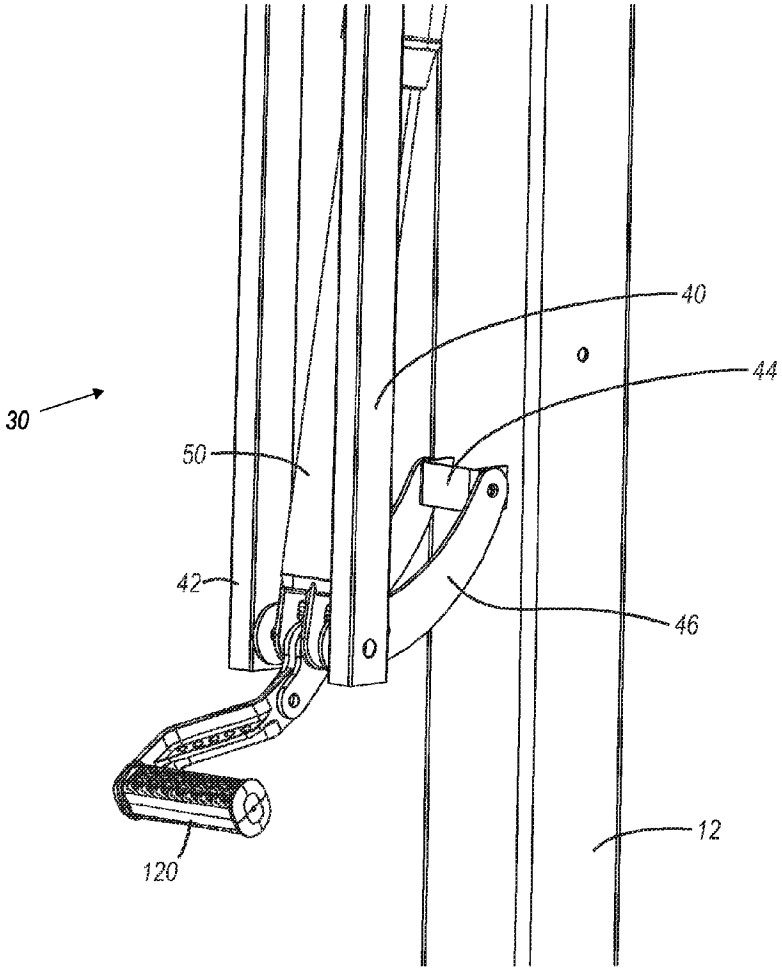
FIG. 9 is a rear perspective view of a portion of the basketball system, illustrating an exemplary handle that may be used in connection with the adjustment mechanism.

Therefore, it will be understood that the height adjustment mechanism 30 and biasing mechanism 50 may have various shapes, sizes, configurations and arrangements depending, for example, upon the intended use of the basketball system 10. For example, as seen in FIG. 9, the height adjustment mechanism 30 may include a handle 120 with a different configuration. The height adjustment mechanism 30 does not require a handle and it could include a lever or other similar structure.

It will also be understood that the height adjustment mechanism and its accompanying parts and components may have other suitable shapes, sizes, configurations and arrangements. For example, as shown in FIGS. 10-13, the height adjustment mechanism 130 may include a first end 134 connected to the support structure 12 and a second end 132 connected to the connecting structure 20. The height adjustment mechanism 130 preferably functions in a similar manner as the height adjustment mechanism 30. In addition, the height adjustment mechanism 130 preferably has a structure similar to the height adjustment mechanism 30, but the various parts and components may have other shapes, sizes, configurations and arrangements.

Figure 10:
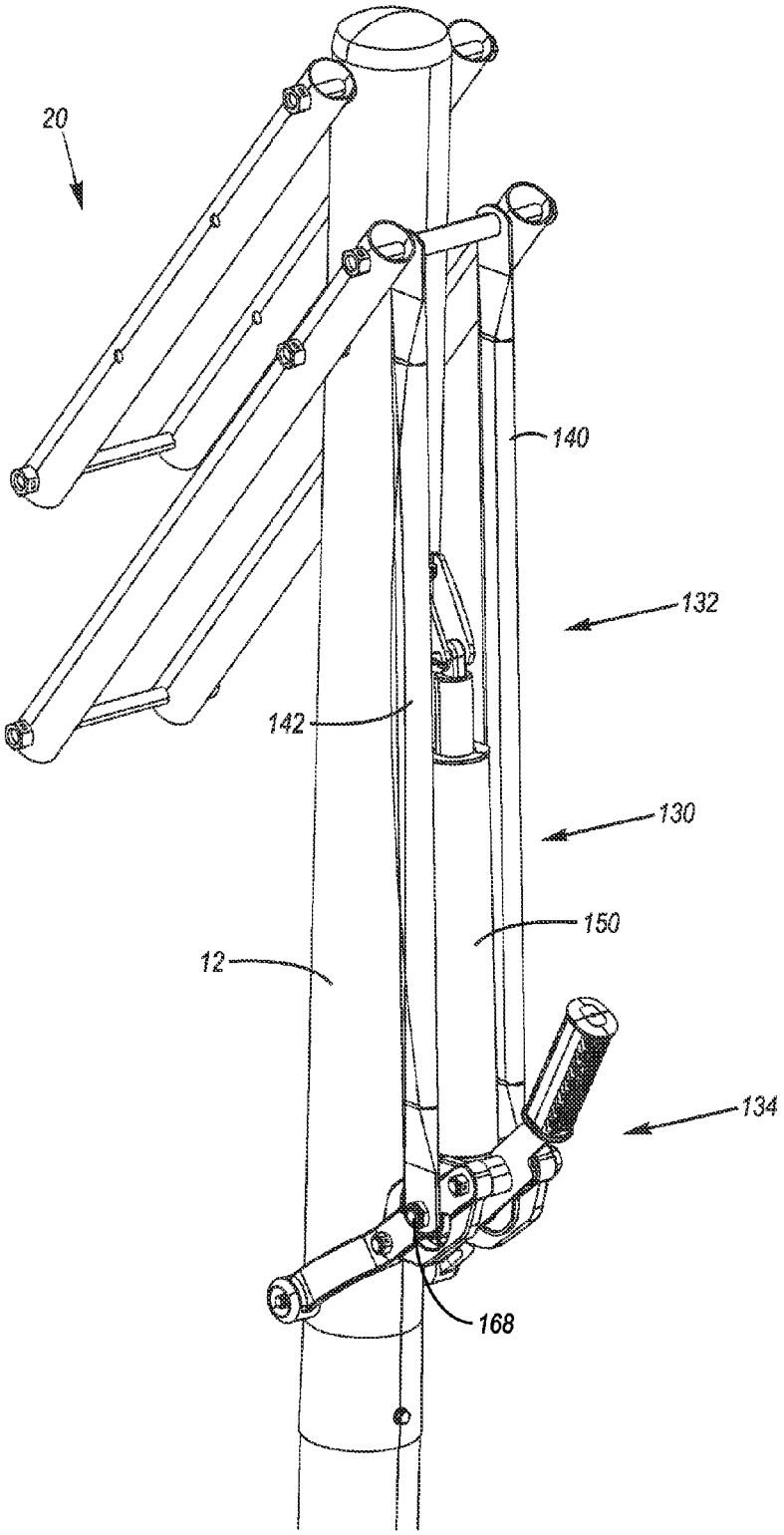
FIG. 10 is a rear perspective view of a portion of another exemplary basketball system with a height adjustment mechanism.
Figure 11:
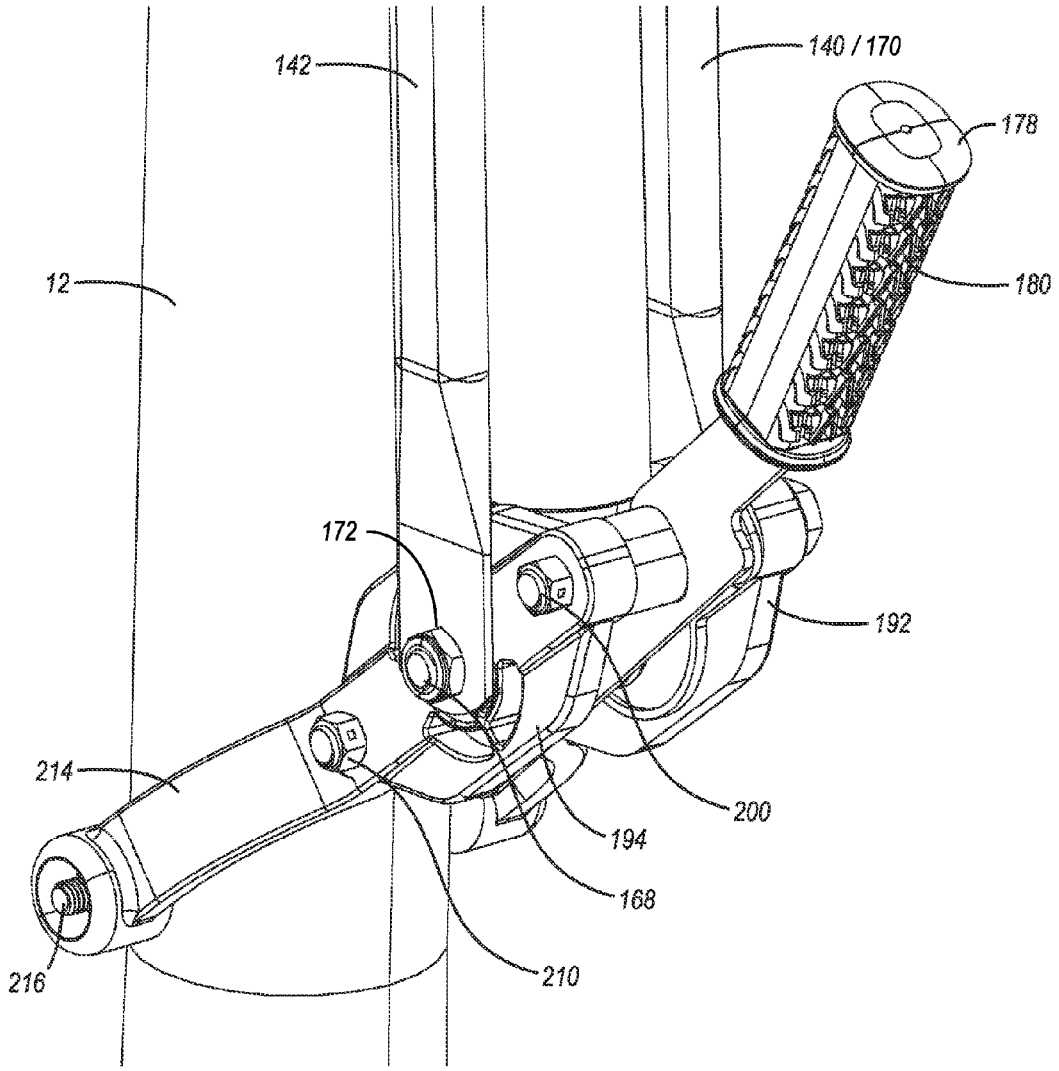
FIG. 11 is an enlarged rear perspective view of a portion of the basketball system shown in FIG. 10.
Figure 13:
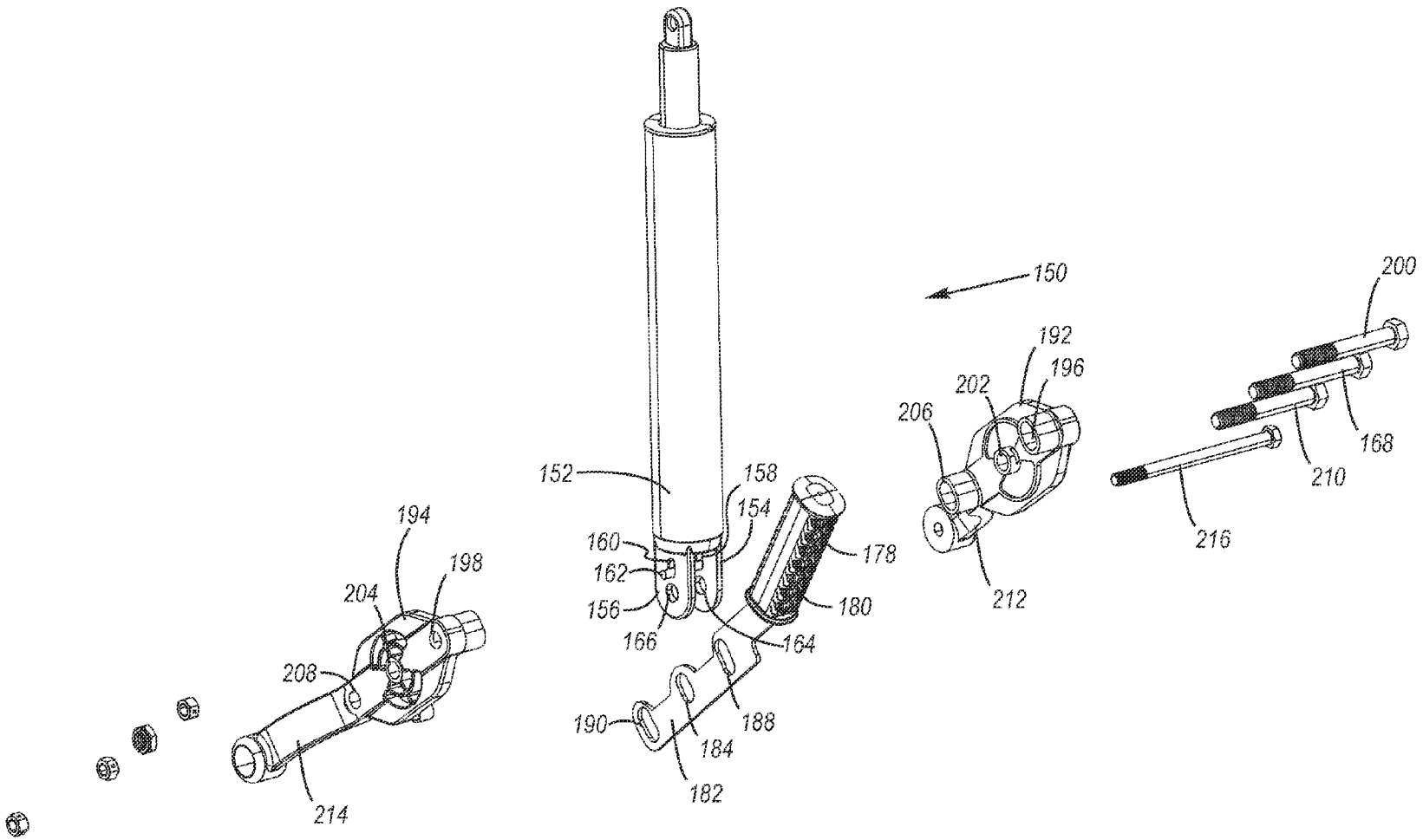
FIG. 13 is another partially exploded view of the portion of the basketball system shown in FIG. 11.
Figure 14:
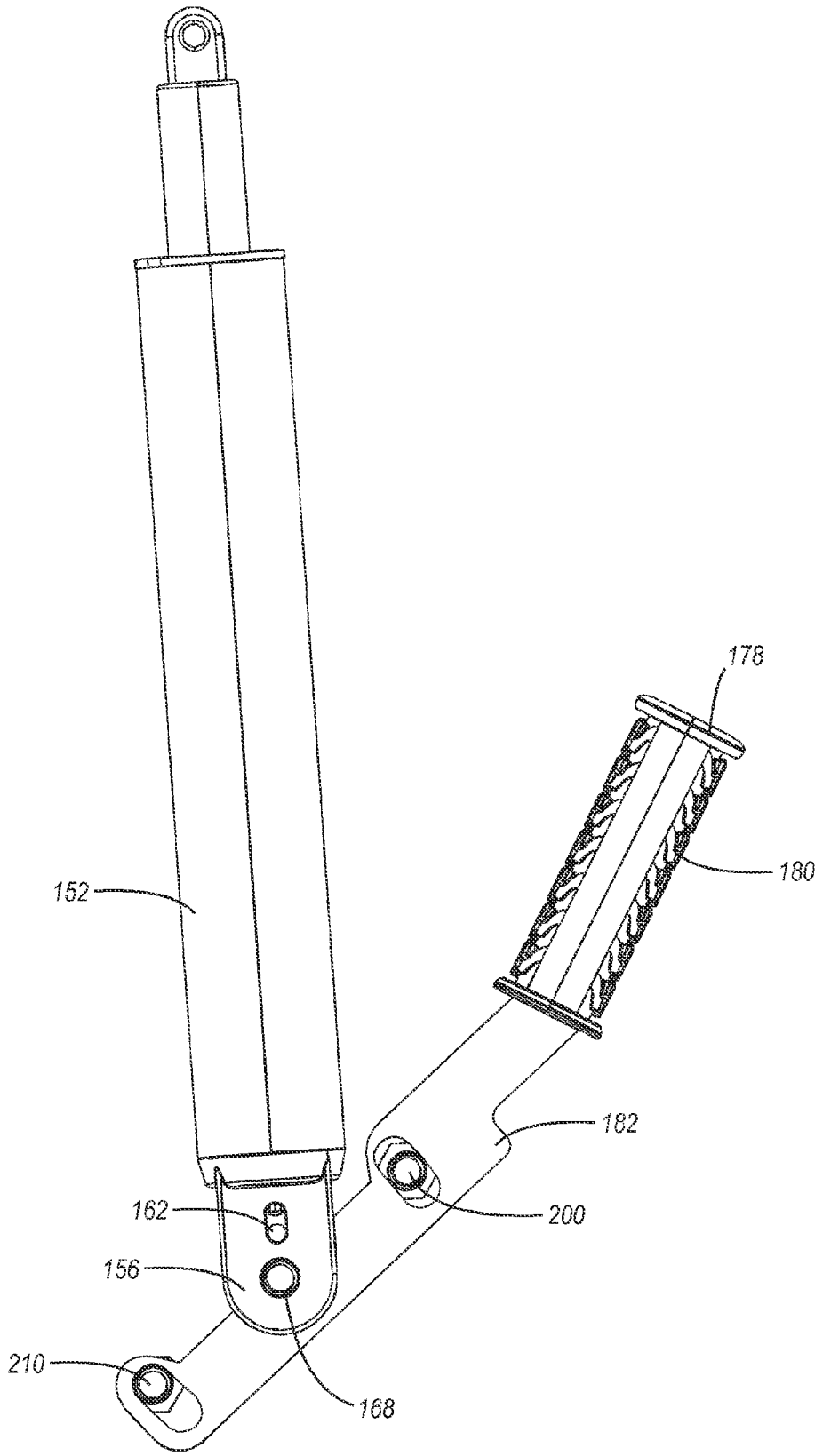
FIG. 14 is a side view of a portion of yet another exemplary height adjustment mechanism for a basketball system.

For example, as best seen in FIG. 13, the biasing mechanism 150 may include an end 152 with flanges 154, 156. The flanges 154, 156 may include slots 158, 160 and a locking pin 162 may be disposed in the slots. The flanges 154, 156 may also include openings 164, 166 and a fastener 168 may be disposed in the openings. As best shown in FIGS. 10 and 11, the fastener 168 may also be disposed within openings 170, 172 in the arms 140, 142 to interconnect the arms and the biasing mechanism 150.

Figure 12:
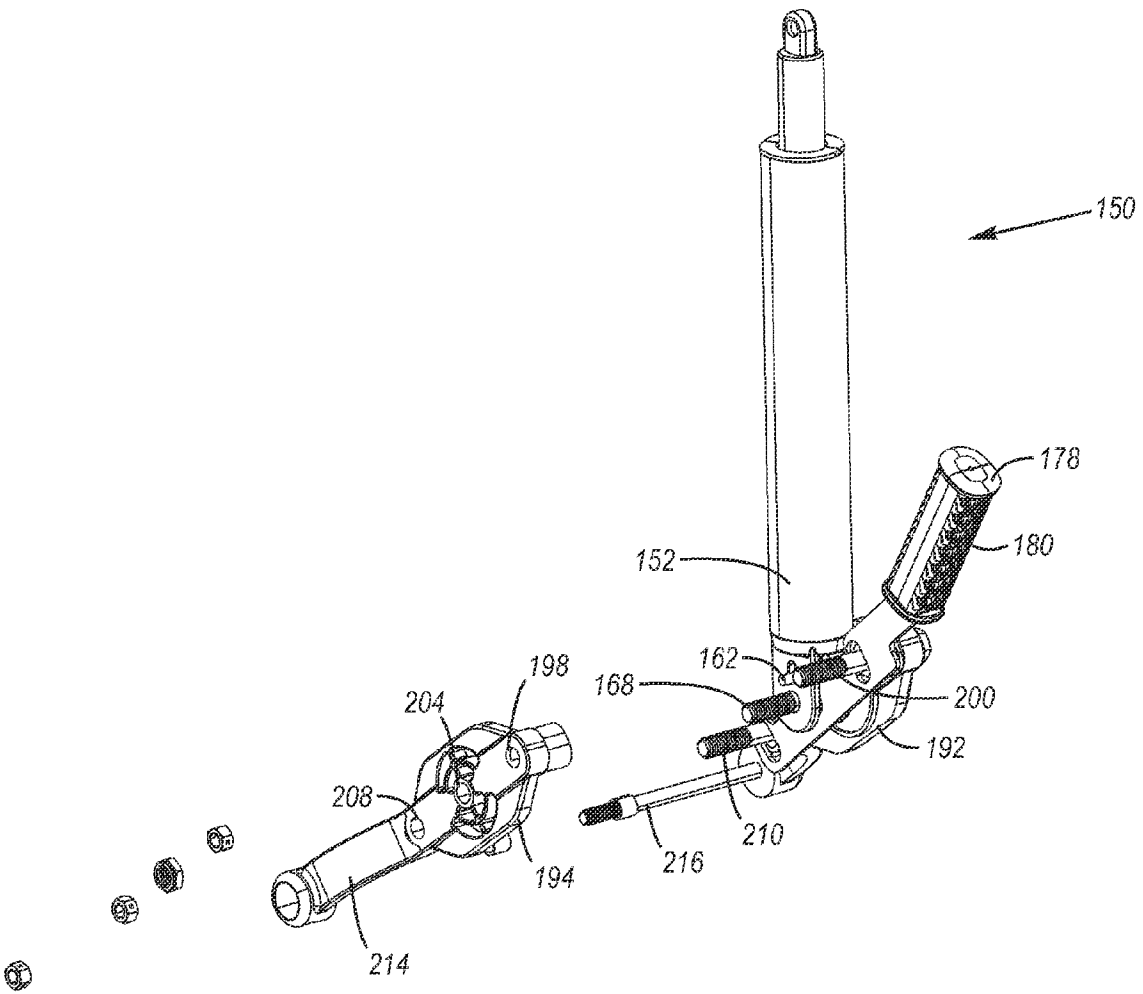
FIG. 12 is a partially exploded view of a portion of the basketball system shown in FIG. 11.

As best seen in FIGS. 12 and 13, a handle 178 may include a gripping portion 180 and an elongated body 182. The handle 178 may also include an opening 184, such as a slot, and an outer surface 186, which may be used to control the movement of the locking pin 162 of the biasing mechanism 150. The handle 178 may also include openings or slots 188, 190 in the elongated body 182.

The height adjustment mechanism 130 may also include a first bracket 192 that may be disposed on one side of the elongated body 182 of the handle 178 and a second bracket 194 that may be disposed on an opposing side of the elongated body of the handle. The first bracket 192 may include a first opening 196 that may be aligned with a first opening 198 in the second bracket 194 and a fastener 200 may be disposed within the openings. The first and second brackets 192, 194 may also include a second opening 202, 204 and the fastener 168 may be disposed within these openings. In addition, the first and second brackets 192, 194 may include third openings 206, 208 and a fastener 210 may be disposed within these openings.

The brackets 192, 194 may include extensions 212, 214 that are sized and configured to attach the brackets to the support structure 12. For example, a fastener 216 may be used to connect the brackets 192, 194 to the support structure 12. Desirably, the brackets 192, 194 are pivotally connected to the support structure 12 by the fastener 216. If desired, the brackets 192, 194 and the extensions 212, 214 may be integrally constructed as part of a unitary, one-piece structure. The brackets 192, 194 and extensions 212, 214, however, could be separate structures that are interconnected, such as by the fastener 210. It will be appreciated that other parts and components of the height adjustment mechanism 130 may also have other suitable shapes, sizes, configurations and arrangements depending, for example, upon the intended use of the basketball system 10.

As shown in the accompanying figures, the openings 184, 188, 190 in the elongated body 182 of the handle 178 are preferably elongated slots. In addition, the openings 196, 198, 202, 204, 206, 208 in the brackets 192, 194 may consist of elongated slots. This may allow, for example, the elongated body 182 of the handle 178 to move relative to the brackets 192, 194. In addition, this may allow one or more of the fasteners 168, 200, 210 to move within one or more of the slots 184, 188, 190, 196, 198, 202, 204, 206, 208. In particular, when the handle 178 is moved upwardly or downwardly, the fasteners 168, 200 and/or 210 may move within the slots 196, 198, 202, 204, 206, 208 and this may allow the biasing mechanism 150 to be unlocked and the height of the basketball goal to be adjusted.

In greater detail, when the handle 178 is moved, the fasteners 168, 200, 210 may allow the handle to move relative to the brackets 192, 194. For example, if the handle 178 is moved upwardly, then one or more of the slots 184, 188, 190, 196, 198, 202, 204, 206, 208 may allow the elongated portion 182 of the handle 178 to move so that the locking pin 162 is moved to an unlocked position and the height of the basketball goal 12 may be adjusted. Alternatively, if the handle 178 is moved downwardly, then one or more of the slots 184, 188, 190, 196, 198, 202, 204, 206, 208 may allow the elongated portion 182 of the handle 178 to move so that the locking pin 162 is moved to an unlocked position and the height of the basketball goal 12 may be adjusted. Preferably, when no force is applied to the handle 178, the locking pin 162 is disposed in a locked position and the basketball goal 12 remains at a fixed height.

In operation, when the handle 178 is moved upwardly, the body 182 of the handle may release the locking pin 162 of the biasing mechanism 150, which allows the height of the basketball goal 14 to be adjusted. For example, this may allow the height of the basketball goal 14 to be lowered. When the handle 178 is moved downwardly, the body 182 of the handle may release the locking pin 162 of the biasing mechanism 150 to allow the height of the basketball goal 14 to be increased.

As discussed above, the movement of the handle 178 preferably both unlocks the height adjustment mechanism 150 and adjusts the height of the basketball goal 14. Thus, a person may only perform the sole function of moving the handle 178 to adjust the height of the basketball goal 14. Because no other functions or tasks have to be performed, it will be understood that the height of the basketball goal 14 may be easily adjusted. It will also be understood that other functions could be performed, if desired. It will further be understood that the biasing mechanisms 50, 150 could have other shapes, sizes, configurations and arrangements depending, for example, upon the intended use of the basketball system 10.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball system comprising:

a basketball goal;

a support structure;

a connecting structure connecting the basketball goal and the support structure; and a height adjustment mechanism connected to the support structure and the connecting structure, and the height adjustment mechanism comprising:

a biasing mechanism connected at least indirectly to the connecting structure, the biasing mechanism including a locking pin movable between a first position where the biasing mechanism is locked and a second position where the biasing mechanism is unlocked; and a handle that is movable relative to the locking pin, the handle including a curved surface configured for sliding contact with the locking pin such that rotation of the handle results in a corresponding linear movement of the locking pin, and the locking pin contacts the curved surface of the handle at different locations on the curved surface as the handle is rotated, and wherein the height adjustment mechanism is configured such that a single movement of the handle is sufficient to effect both unlocking of the biasing mechanism and adjustment of a height of the basketball goal relative to a playing surface.

2. The basketball system as recited in claim 1, wherein the height adjustment mechanism is configured such that a single movement of the handle is sufficient to effect: unlocking of the biasing mechanism; adjustment of a height of the basketball goal relative to a playing surface; and, locking of the biasing mechanism.

3. The basketball system as recited in claim 1, wherein the height adjustment mechanism is configured such that a single movement of the handle is sufficient to effect, almost simultaneously, both unlocking of the biasing mechanism and adjustment of a height of the basketball goal relative to a playing surface.

4. The basketball system as recited in claim 1, wherein a downward movement of the handle causes the release mechanism to move from the locked position to the unlocked position and causes the height of the basketball goal to be adjusted.

5. The basketball system as recited in claim 1, wherein the locking pin is biased into the first position.

6. The basketball system as recited in claim 1, further comprising a bracket connected to the handle and the biasing mechanism, the bracket including a curved surface configured to cooperate with the curved surface of the handle to effect a change in position of the locking pin.

7. The basketball system as recited in claim 1, further comprising a link connected to the biasing mechanism and the support structure.

8. The basketball system as recited in claim 1, wherein the biasing mechanism includes a slot that defines a linear range of motion of the locking pin.

9. The basketball system as recited in claim 1, wherein the biasing mechanism provides a counterbalance to the basketball goal.

10. The basketball system as recited in claim 1, wherein the biasing mechanism includes one or more springs.

11. The basketball system as recited in claim 1, further comprising:

first and second brackets connected to the handle and the biasing mechanism, each of the brackets including an outer surface configured to cooperate with the outer surface of the handle to effect a change in linear position of the locking pin;

first and second links connected to the biasing mechanism, brackets and the support structure; and a pair of arms connected to the links and the connecting structure.

12. A basketball system comprising:

a basketball goal;

a support structure;

a connecting structure connecting the basketball goal and the support structure; and a height adjustment mechanism connected to the support structure and the connecting structure, and the height adjustment mechanism comprising:

a biasing mechanism connected at least indirectly to the connecting structure, the biasing mechanism including a locking pin movable between a first position where the biasing mechanism is locked and a second position where the biasing mechanism is unlocked;

a handle configured to enable movement of the locking pin between the first and second positions, and the handle including first, second and third slots;

first and second brackets, each bracket including first, second and third slots, wherein the brackets are pivotally connected to the support structure; and first, second and third fasteners, wherein the first fastener passes through the first slot of the handle and the first slot of each bracket, the second fastener passes through the second slot of the handle and the second slot of each bracket to rotatably connect the handle to the biasing mechanism, and the third fastener passes through the third slot of the handle and the third slot of each bracket, and wherein the fasteners and handle are configured for translational movement relative to each other.

13. The basketball system as recited in claim 12, wherein the height adjustment mechanism is configured such that a single movement of the handle is sufficient to effect both unlocking of the biasing mechanism and adjustment of a height of the basketball goal relative to a playing surface.

14. The basketball system as recited in claim 12, wherein the handle includes an outer surface configured such that rotation of the handle results in a corresponding linear movement of the locking pin as the outer surface slidingly engages the locking pin.

15. The basketball system as recited in claim 12, wherein the locking pin is biased into the first position.

16. The basketball system as recited in claim 12, wherein the handle is movable relative to the brackets.

17. The basketball system as recited in claim 12, wherein when the handle is moved upwardly, the handle releases the locking pin and enables the basketball goal to be lowered.

18. The basketball system as recited in claim 12, wherein when the handle is moved downwardly, the handle releases the locking pin and enables the basketball goal to be raised.

* * * * *

UNITED STATES PATENT AND TRADEMARK OFFICE

CERTIFICATE OF CORRECTION

PATENT NO. : 8,348,788 B2
APPLICATION NO. : 13/253762
DATED : January 8, 2013
INVENTOR(S) : Nye et al.

It is certified that error appears in the above-identified patent and that said Letters Patent is hereby corrected as shown below:

In the Specification

Column 6
Line 43, change “that” to --than--

Column 9
Line 41, change “biasing mechanism” to --biasing mechanism 50--

Column 11
Line 5, change “body of the handle” to --body 182 of the handle 178--

Signed and Sealed this
Seventeenth Day of September, 2013

Teresa Stanek Rea
*Deputy Director of the United States Patent and Trademark Office*